United States Patent [19]

Furey

[11] Patent Number: 4,562,757

[45] Date of Patent: Jan. 7, 1986

[54] HIGH TORQUE EXPANDABLE SOCKET RATCHET WRENCH

[76] Inventor: James Furey, 36 Harborhead Dr., Point Pleasant Beach, N.J. 08742

[21] Appl. No.: 700,727

[22] Filed: Feb. 12, 1985

Related U.S. Application Data

[63] Continuation of Ser. No. 475,361, Mar. 14, 1983, abandoned.

[51] Int. Cl.[4] ..... B25B 13/46

[52] U.S. Cl. ..... 81/63; 81/58.2

[58] Field of Search ..... 81/60–63.2, 81/58.2

[56] References Cited

U.S. PATENT DOCUMENTS

| | | | |
|---|---|---|---|
| 341,986 | 5/1886 | Alapaw | 81/58.2 X |
| 493,273 | 5/1893 | Killinger | 81/58.2 X |
| 2,446,776 | 8/1948 | Matson | 81/63 |
| 2,521,419 | 9/1950 | Sellers | 81/58.2 X |
| 2,636,411 | 4/1953 | Wood | 81/58.2 |

*Primary Examiner*—James G. Smith
*Assistant Examiner*—Debra S. Meislin
*Attorney, Agent, or Firm*—Louis E. Marn

[57] ABSTRACT

A ratchet wrench usable in areas of limited access normally requiring an open-end wrench, but possessing the high torque characteristics of a closed-end socket wrench is disclosed. A handle member terminates in an expandable yoke containing a fixed upper half and an expandable lower half for movement from an expanded open position for receiving a socket to a closed position in driving engagement with the socket. A curved rib is formed transversely on the inner surface of each yoke half. A split ring-like nut driving socket contains exterior ratchet teeth and a circular bore formed transversely through the socket with a recessed counter bore forming a circular guide channel in the socket concentric with the transverse bore. The socket guide channel is received in rotational engagement with the curved ribs of the yoke halves. The socket contains a curved head having lands which in combination define a polygonal wrench opening. A pawl mechanism mounted on the wrench handle member is resiliently biased into engagement with the ratchet teeth of the socket, thereby allowing it to turn in one direction only, and preventing rotation of the socket in the opposite direction. The split ring-like nut driving socket permits circumferential engagement of a nut through movement transverse to the socket access and the two-piece expandable yoke permits engagement of the socket by means of movement of the handle member transverse to the socket access.

4 Claims, 6 Drawing Figures

HIGH TORQUE EXPANDABLE SOCKET RATCHET WRENCH

This is a continuation of application Ser. No. 475,361, filed Mar. 14, 1983, now abandoned.

BACKGROUND OF THE INVENTION

The invention generally relates to ratchet wrench construction and more specifically to improvements to ratchet wrenches of the socket type usable in areas of limited access normally limiting wrench use to the open-ended type.

There are a number of applications in which a closed-end or socket wrench is preferred for use in making or breaking a high torque union. In locations with a turning radius of at least 30 degrees, the open-ended wrench may be used by merely reversing of the wrench position with each turn. The wrench, of course, must be inserted, turned, removed, and then reinserted. This action is both time-consuming and difficult if the element is not turned the proper amount.

Additionally, there are a number of instances where the nut or bolt head is disposed in a relatively inaccessible location which limits the stroke range for back and forth manipulations and, of equal importance, limits the area in which a ratchet wrench may be positioned to engage the nut or bolt.

SUMMARY OF OBJECTS OF THE INVENTION

It is, therefore, the principal object of the present invention to provide a ratchet wrench having a split ring-like socket head which can be positioned around a nut or bolt head to permit the wrench to be moved into torque transmitting engagement with the wrench lands of a nut or bolt head and thereafter operated as a closed box ratchet wrench for making or breaking a union.

Another object of the invention is to provide a ratchet wrench with an expandable yoke which permits the wrench to be moved into torque transmitting engagement with the socket head by means of movement of the wrench handle transverse to the socket axis in areas of limited access which preclude movement of the wrench handle longitudinal to the socket access until the yoke telescopically receives the socket.

yet another object of the invention is to provide a high strength split ring-like socket assembly for use in a ratchet wrench which socket assembly permits circumferential engagement of a nut through movement of the socket transverse to the socket axis.

Yet another object of the invention is to provide a ratchet wrench having a split ring-like socket which is readily removable and interchangeable with other similar sockets to permit the wrench to be used in combination with nuts or bolt heads of a variety of standard drive head configurations.

SUMMARY OF THE INVENTION

The foregoing and other objects are accomplished in the present invention by a ratchet wrench assembly in which a split ring-like socket is rotatably journalled with the yoke portion of a ratchet wrench. A handle member terminates in an expandable yoke portion containing a fixed upper half and an expandable lower half for movement from an expanded open position for receiving a socket through movement transverse to the socket axis to a closed position in engagement with the socket. A curved rib is formed transversely on the inner surface of each yoke half. A split ring-like nut driving socket contains exterior ratchet teeth and a circular bore formed transversely through the socket with a recessed counter bore forming a circular guide channel in the socket concentric with the transverse bore. The socket guide channel is received in rotational engagemet with the curved ribs of the yoke halves. The socket contains a curved head having lands which in combination define a polygonal wrench opening. A pawl mechanism mounted on the wrench handle member is resiliently biased into engagement with the ratchet teeth of the socket, thereby allowing it to turn in one direction only and preventing rotation of the socket in the opposite direction.

The novel features which characterize the invention are defined by the appended claims. The foregoing and other objects, advantages and features of the invention will hereinafter appear, and for purposes of illustration of the invention, but not by way of limitation, an exemplary embodiment of the invention is shown in the appended drawing.

DETAILED DESCRIPTION OF THE PREFERRED EMBODIMENTS

Figure 1:
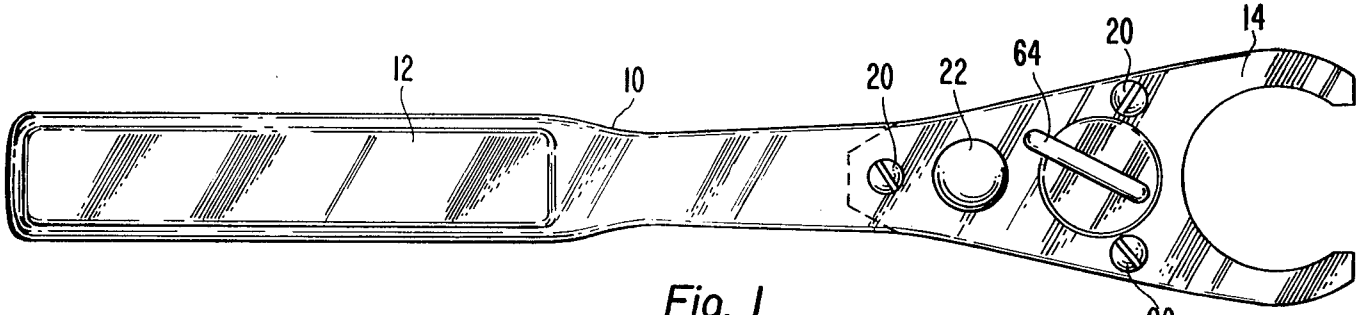
FIG. 1, is a top plan view of the socket ratchet wrench constructed according to the teachings of the invention.

In the description which follows, the parts are marked throughout the specification and drawing with the same reference numerals, respectively. The drawings are not necessarily to scale and in some instances portions have been exaggerated in order to more clearly depict certain aspects of the invention described.

Figure 2:
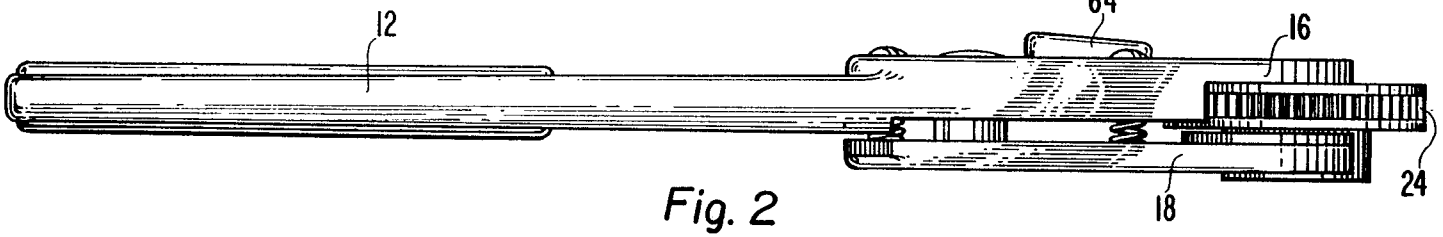
FIG. 2, is a side view of the wrench shown in FIG. 1 with the lower yoke half in expanded position.
Figure 3:
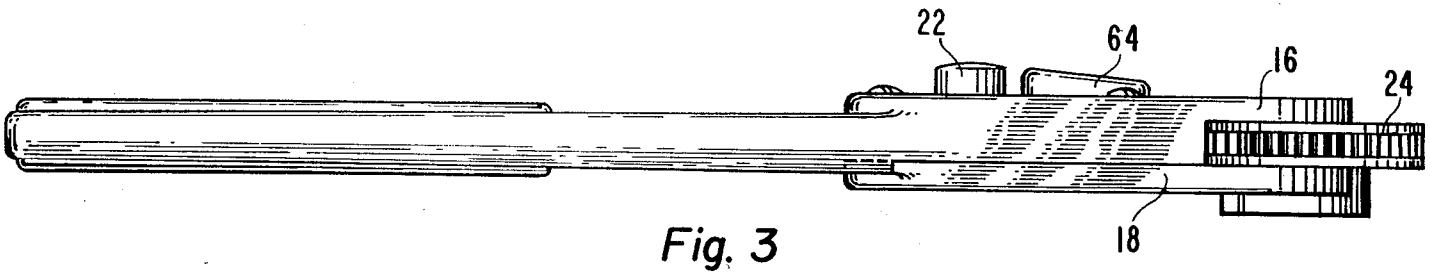
FIG. 3, is a side view of the wrench shown in FIG. 1 with socket engaged.

Referring now to FIG. 1, a high torque expandable socket ratchet wrench assembly constructed according to the teachings of the invention is identified generally by the reference numeral 10. The principal components of the ratchet wrench assembly include an elongated handle member 12 which is connected at one end by an expandable yoke assembly generally indicated as 14 having a fixed top half 16 and an expandable bottom half 18, as shown in FIGS. 2 and 3. The yoke halves are coupled for expansion and contraction between open and closed positions by means of resiliently biased retaining screws 20 and detent gear assembly 22. Received in rotational coupling engagement with the upper and lower yoke halves is split ring-like socket assembly generally indicated as 24.

Figure 6:
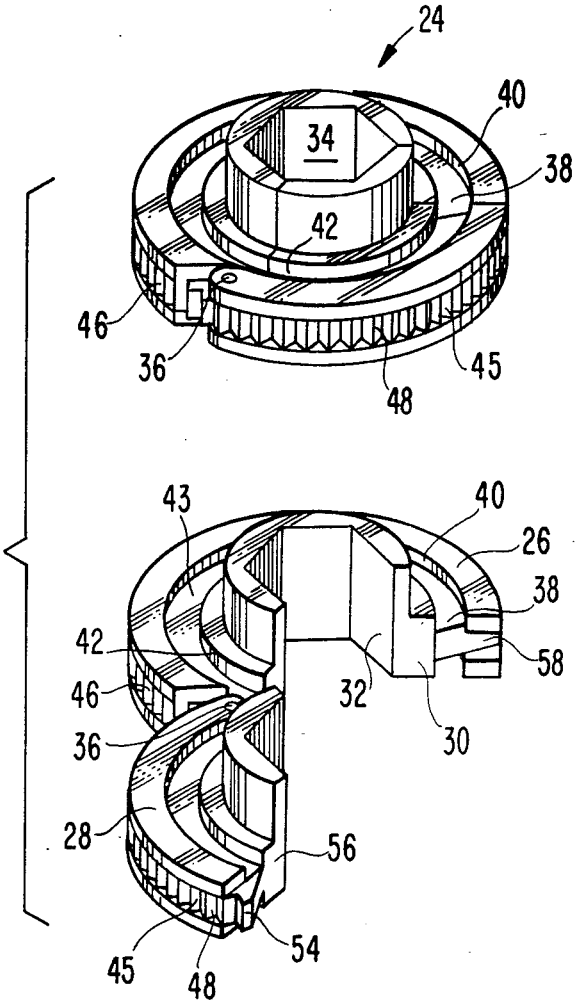
FIG. 6, is a perspective view of the socket assembly in closed and open positions.

As best observed in FIG. 6, the socket assembly 24, comprises a pair of complemental substiantially semicircular members 26, 28 coupled by means of pin 36. Each socket member includes a curved head 30 having interior land wrench surfaces 32 which in combination define a polygonal opening 34.

Additionally, each socket member is formed with a cylindrically-shaped guide channel 43 defined by a discshaped bottom wall 38 and inner and outer side walls 40 and 42. The cylindrically-shaped curved rib 44 of each yoke half is journalled for rotation in the guide channel 43. Each guide channel and rib 44 are preferably rectangular in cross section and extend along a semi-circular path.

According to an important feature of the invention, this overlapping, journalled engagement of the socket guide channel and yoke rib produces an interlocking engagement of the wrench yoke and socket resulting in a stable structure having a high torque transmitting capacity.

Secured to each socket member is a curved ratchet 45, 46 which in combination define a continuous ratchet wheel as best seen in FIG. 6. Each curved ratchet includes a series of teeth 48 for engaging a pawl 50 carried on the fixed yoke member 16.

According to an important feature of the invention, socket member 28 contains a single tooth member 54 which extends beyond the plan of side wall planar surface 56 for mating engagement into the recess 58 of socket member 26 created by the absence of a single ratchet tooth member. This mating of socket members 26 and 28 produces an interleaved engagement resulting in a structure having a high stable closed bond.

Figure 4:
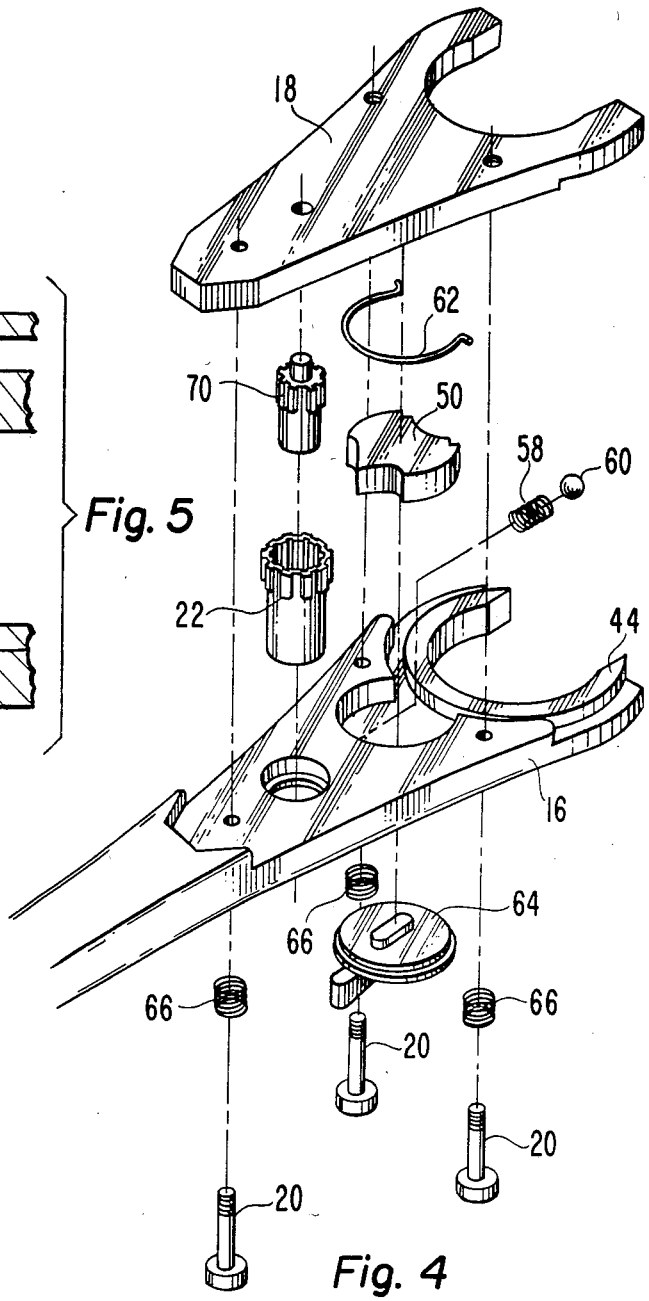
FIG. 4, is an expanded view of the wrench shown in FIG. 1.

Referring to FIG. 4, the pawl 50 is resiliently biased by means of spring 58 and ball-bearing 60 with the teeth 48 of socket 24. The pawl 50 is pivotally mounted and anchored in place by spring retainer 62. A selector switch 64 permits indexing of the pawl 50 so as to permit ratcheting in either a clockwise or counterclockwise direction.

Figure 5:
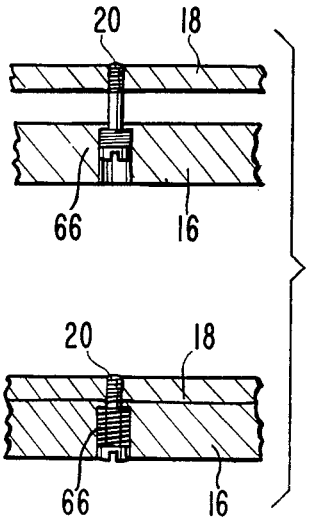
FIG. 5, is a sectional view showing mounting screws in expanded and closed positions.

According to a further important feature of the invention, yoke halves 16 and 18 are coupled together in a closed position by means of resiliently biased retaining screws 20 and springs 66 as shown in FIGS. 3 and 5 (lower portion). Upon depression of plunger 22, yoke half 18 is displaced a given distance of sufficient width to disengage or engage socket member 24 and is held in expanded position as shown in FIG. 2. In this expanded position, handle member 12 is moved transverse to the socket axis so as to engage socket member 24 previously positioned about a given nut or bolt head by means of movement transverse to the nut or bolt head axis. Upon subsequent release of plunger 22, yoke half 18 is caused to be returned to its original closed position by means of biasing springs 66, thus achieving interlocking engagement with socket member 24.

From the foregoing description of a preferred embodiment of the invention, those skilled in the art will appreciate that the expandable ratchet wrench of the present invention provides a high torque capacity ratchet assembly which may be quickly and easily utilized in situations requiring a ratchet or a closed box end wrench in areas of limited access. The provision of the interleaved yoke rib and socket channel combination strengthens and stabilizes the wrench structure.

Although a preferred embodiment of the invention has been described in detail, it should be understood that various changes, substitutions and alterations can be made therein without departing from the spirit and scope of the invention as described.

What is claimed is:

1. A high torque socket ratchet wrench assembly, which comprises:

a driving socket assembly, said driving socket assembly being circular and comprised of a pair of complemental, substantially semi-circular socket members formed with a curved head including exterior ratchet teeth and interior wrench land surfaces, said socket members cooperating to define in a closed position a polygonal opening by said land surfaces and defining an axis of rotation of said driving socket assembly, said socket members formed with upper and lower guide channels defined by a circular bottom wall and an inner and outer cylindrically-shaped side wall; and an elongated handle assembly for receiving said driving socket assembly, said elongated handle assembly comprised of an elongated handle member formed with an upper yoke member having a semi-circular interior disposed rib member defined by a semicircularly-shaped end wall and inner and outer cylindrically-shaped walls depending downwardly from said semi-circularly disposed end wall, a lower yoke member formed with a semi-circular interior rib member defined by a semi-circularly-shaped end wall and inner and outer cylindrically-shaped walls depending downwardly from said semi-circularly disposed end wall, said lower yoke member mounted to said elongated handle member to move into an expanded open position with respect to said upper yoke member of said elongated handle member whereby said upper and lower yoke members in said expanded open position permit positioning of said driving socket assembly between said upper and lower yoke members, said rib members of said upper and lower yoke members engaging said upper and lower guide channels of said socket members forming said driving socket assembly in a closed position of said upper and lower yoke members by cooperation between said inner and outer cylindrically-shaped side walls of said rib members with said inner and outer cylindrically-shaped inner and outer side walls of said guide channels, respectively, means for transversely expanding said upper yoke member relative to said lower yoke member, means to maintain said upper yoke member relative to said lower yoke member in planar parallel relationship when in sid expanded open and closed positions, and a pawl member disposed in said elongated handle assembly to cooperate with said ratchet teeth of said pair of semi-circular socket members forming said driving socket assembly, said pawl member being spring-biased.

2. The high torque socket ratchet wrench assembly as defined in claim 1 wherein said rib members of said yoke members engage said driving socket asembly about an arc greater than 180° of said driving socket assembly.

3. The high torque socket ratchet wrench assembly as defined in claim 1 wherein said expandable lower yoke member is spring-biased into a closed position.

4. The high torque socket ratchet wrench assembly as defined in claim 1 wherein said guide channels and rib members are rectangularly-shaped in cross-section.

* * * * *